US005503315A

United States Patent [19]

Ruzika et al.

[11] Patent Number: 5,503,315

[45] Date of Patent: Apr. 2, 1996

[54] SHOULDER STRAP FOR ELECTRIC OR ACOUSTIC GUITAR

[75] Inventors: Roy T. Ruzika, Washington; Jess A. Pelligrino, Charleroi; Anthony J. Janflone, Washington, all of Pa.

[73] Assignee: Performance Solutions, Eighty Four, Pa.

[21] Appl. No.: 370,619

[22] Filed: Jan. 10, 1995

Related U.S. Application Data

[63] Continuation-in-part of Ser. No. 109,220, Aug. 19, 1993, abandoned.

[51] Int. Cl.[6] ..... A45F 3/14

[52] U.S. Cl. ..... 224/257; 224/910; 224/258; 24/265 R

[58] Field of Search ..... 224/257, 258, 224/910; 24/196, 616, 585, 265 RX; 84/327, 376

[56] References Cited

U.S. PATENT DOCUMENTS

| | | | |
|---|---|---|---|
| 4,144,794 | 3/1979 | Silverman et al. | 224/257 |
| 4,148,423 | 4/1979 | Schlacher | 324/258 |
| 4,291,822 | 9/1981 | Simonds | 224/257 |
| 4,843,943 | 7/1989 | Hoshino | 224/910 |
| 4,993,127 | 2/1991 | Mechem et al. | 84/327 |
| 5,044,538 | 9/1991 | Bader | 224/258 |

*Primary Examiner*—Henry J. recla
*Assistant Examiner*—David J. Walczak
*Attorney, Agent, or Firm*—Titus & McConomy

[57] ABSTRACT

A shoulder strap for musical instruments, in particular guitars, which includes a first and second portion. The first portion is arcuate from its end to the beginning of the second portion. Each end of the support is adapted to attach to a musical instrument by means of a pivot member and a connecting element.

3 Claims, 2 Drawing Sheets

SHOULDER STRAP FOR ELECTRIC OR ACOUSTIC GUITAR

This is a continuation-in-part of application(s) Ser. No. 08/109,220 filed on Aug. 19, 1993, now abandoned.

FIELD OF THE INVENTION

The invention relates to a shoulder support strap for electric and acoustic guitars, basses and other fretted instruments.

BACKGROUND OF THE INVENTION

The use of shoulder straps to support musical instruments in their playing position is well known. Straps have been used with guitars and other heavy instruments. Typically, prior art straps are made of leather, nylon or other flexible material and may include a pad for dispensing the weight on the player's shoulder. For the most part, the straps have been formed much like a belt, that is, a linear configuration which performs the support task well.

It is also well known that while prior art straps provide support for the instrument during a performance, they are not comfortable. In most cases, the prior art straps attach to the guitar at a 90° angle to the player's body, therefore, "riding" up the shoulder, twisting, and adversely effecting the neck. Attempts have been made to overcome these adverse effects, but they have not met with a great deal of success. See, eg. U.S. Pat. No. 4,148,423 which purports to provide a shoulder conforming curve intermediate of the ends of the strap.

Generally, attempts to alleviate the discomfort of the instrument strap have not been successful. Prior art straps, even those that are fairly wide, for example three to four inches, support all of the weight on a one-half inch section on the shoulder of the player. Many guitarists play their instruments in extremely low positions in order to ensure that the distance between the connection to the guitar and the player's shoulder is great enough to allow the strap to lie flat which would otherwise be angled and twisted. This solution, however, prevents achievement of optimum playing position, thus, degrading the performance. Moreover, it does not alleviate the placement of all of the weight on the player's shoulder.

Accordingly, it is an object of the present invention to provide an improved shoulder strap for musical instruments which is comfortable to wear and provides adequate instrument support. It is a further object of the invention to provide a shoulder strap having pivot means to further enhance the comfort and position of the instrument during play. It is a further object of the invention to provide a strap that does not twist or bind and remove some of the weight of the instrument from the shoulder to along the back. It is another object of the invention to improve the position of the instrument for playing by shifting the weight thereof directly from the shoulder to across the back of the player.

SUMMARY OF THE INVENTION

Generally, the present invention provides a shoulder strap having first and second support portions. The first portion is arcuate in configuration and is designed to lie across the back of the player and the second support portion is linear and designed to lie across the shoulder. The end of support position includes attachment means for the attachment to the instrument. One of the attachment means located at the end adjacent the struts of an instrument such as a guitar includes a pivot means for attachment to the instrument. The combination of strap configuration and pivot means provides the unique balancing of weight distribution across the shoulder and the back to afford both comfort and support. Other advantages of the invention will become apparent from a perusal of the following detailed disposition of presently preferable embodiments taken in connection with the accompanying drawings.

PRESENTLY PREFERRED EMBODIMENTS

Figure 1:
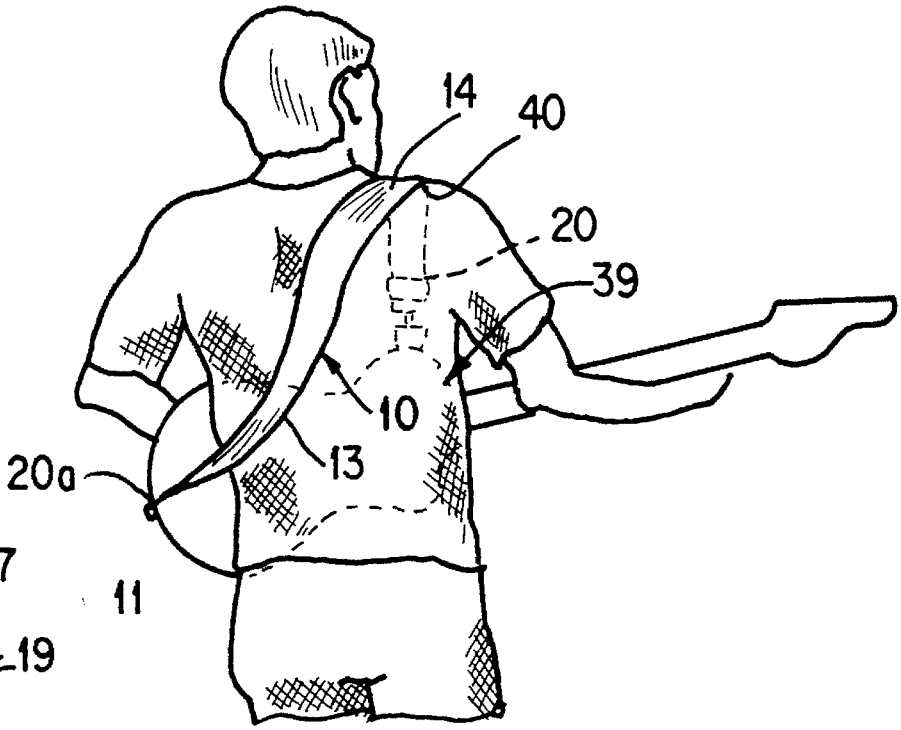
FIG. 1 shows the shoulder strap of the present invention attached to an electric guitar and supported on the shoulder of performer.
Figure 2:
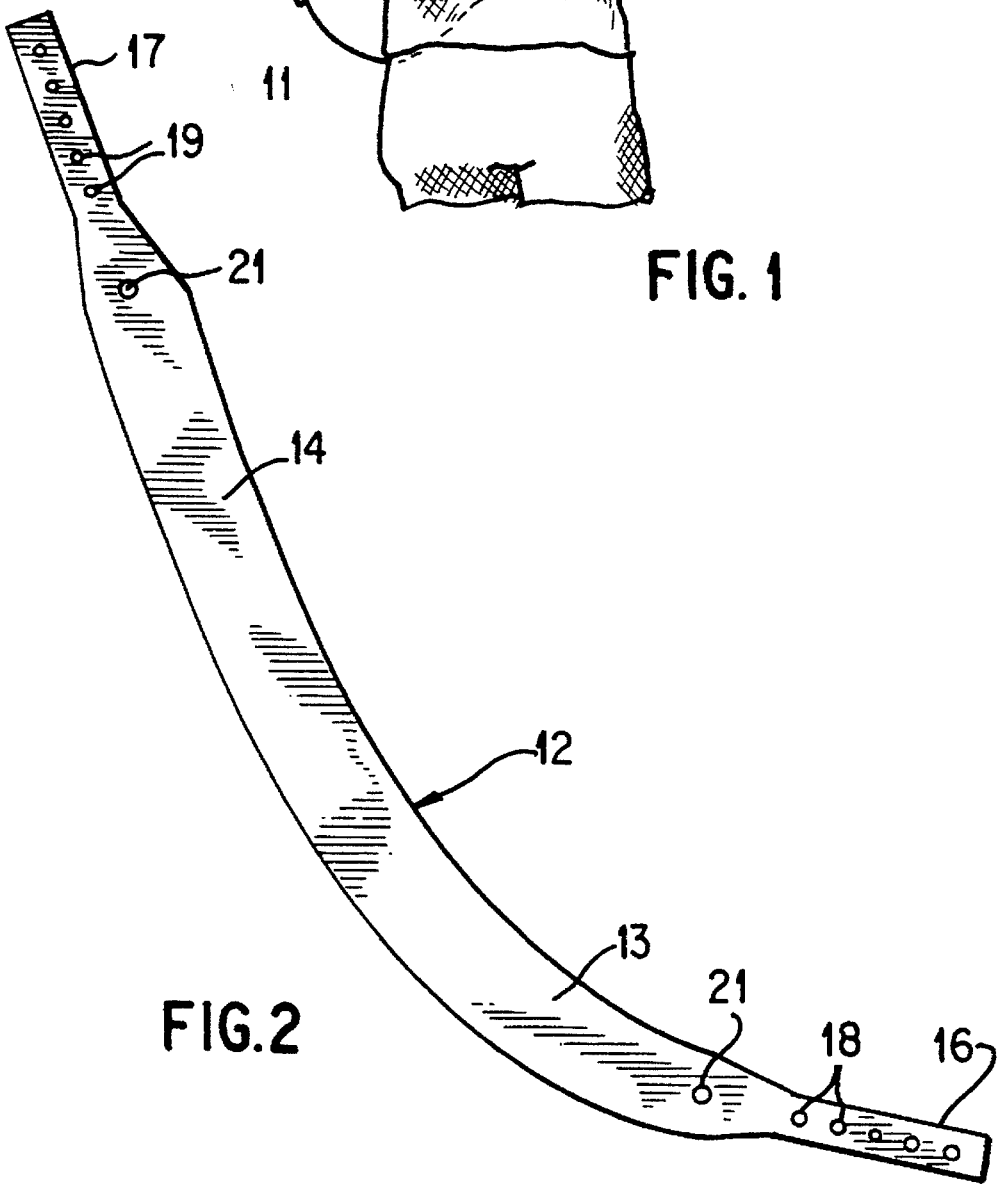
FIG. 2 is a plain view of the support means without the pivot means attached.
Figure 3:
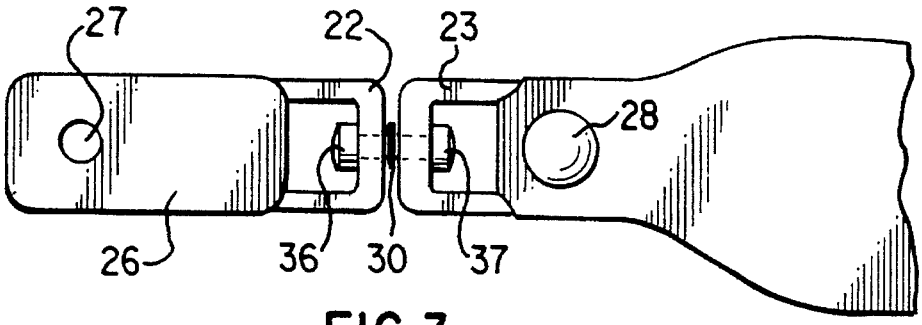
FIGS. 3 and 4 are side elevations of the pivot means.
Figure 4:
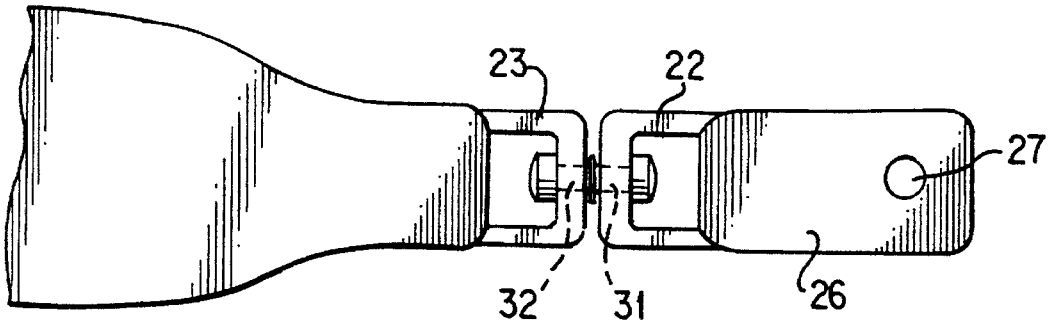
Figure 5:
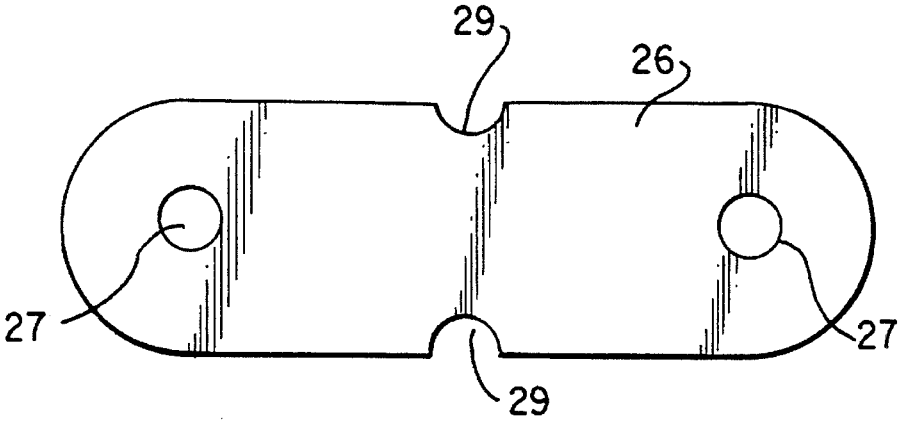
FIG. 5 is a plain view of the connector means for use with a pivot.

Referring to FIGS. 1 and 2, shoulder strap 10 is shown attached to electric guitar 11. Shoulder strap 10 comprises support 12 having an arcuate first portion 13 and a linear second portion 14, pivot means 20 and connector means (FIG. 5). Each portion 13 and 14 includes an end member 16 and 17, respectively. Each end member 16 and 17 can include a plurality of opening 18 and 19 respectively, for attachment to an instrument's attachment posts or through a pivot means 20 as described hereinafter. Support 12 is preferably made from leather or a web or ballistic nylon.

In the preferred embodiment, the attachment means includes a pivot 20 at one end but may include a pivot at both ends of support 12. Pivot means 20 preferably comprise a pair of metal or plastic buckles 22 and 23. Buckle 22 receives connector means 26, shown in FIG. 5, which is looped through the opening in buckle 22 and doubled back onto itself so that openings 27 align with each other for fastening to a guitar attachment post directly, or by means of a commercial strap locking device, not shown. A pair of cutouts 29 are preferably included on connector means 26 such that their distance apart is dimensioned to equal the inner space within buckle 22. Buckle 23 is attached to an end member 16 or 17 through an associated opening 18 or 19 and secured by button or rivet 28. A second buckle 23 may also be attached to the other end member 16. Buckles 22 and 23 are joined pivotally together by pivot arm 30 which rotates in associated opening 31 and 32 through the ends of the respective buckles 22 and 23. Pivot arm 30 includes end caps 36 and 37 to retain arm 30 within the openings.

In the presently preferred embodiment, first portion 13 of support 12 is arcuate and has an outer radius of about 18.5 to 22.5 inches. Preferably the radius is about 20.25 inches. Support 12 is preferably about 2.5 inches in width throughout the length of both first and second portions. Opening 18 and 19 through the end members are preferably about ⅜ inch in diameter when used for pivot means 20 and end members 16 and 17 are approximately 7 inches in length and one inch in width when used with pivot 20, otherwise end 16 can be 3 to 5 inches and opening 18 dimensioned to fit an attachment post 20*a*.

Connector means 26 varies in length depending on the instrument. For example, the distance between openings 27 (FIG. 5) is about 3 inches for an electric guitar but preferably about 10 inches for an acoustic guitar. Slight variations are required because of wider bodies associated with acoustic guitars.

A pair of openings 21 are included on support 12 for attaching the respective end member 16 or 17 by rivet 28. Openings 21 are located approximately 2¼ inches from the nearest opening 18 or 19. The distance between openings 21 is approximately 28 inches. In the preferred case where only one pivot means 20 is utilized, openings 18 in end member 16 are preferably dimensioned to fit the attachment post on the instrument. In such case, opening 21 on end member 16 can be eliminated.

Shoulder strap 10 of the invention lies flat on the shoulder 40 (FIG. 1) and does not ride up against the player's neck or place all of the instrument's weight on the shoulder, because of the pivot means 20 located adjacent the strut 39 of the instrument and the nonpivot attachment at 20*a*. Arcuate portion 13 lies across the back of the instrument player to assist in distributing the weight of the instrument from the shoulder to the back.

While presently preferred embodiment has been described in particular with respect to electric and acoustic guitars, the invention may be otherwise embodied within the scope of the appended claim.

What is claimed:

1. A shoulder strap for musical instruments comprising a. a support elongated within a longitudinal plane having first and second portion and first and second attachment means at respective opposite ends of said support, said first portion of said support being arcuate within said plane and said second portion being substantially linear within said plane for positioning over a shoulder;

b. at least one fully rotational pivot means attached to one of said art attachment means of said support; and c. connector means secured to said pivot means for pivotally connecting said connector means to a musical instrument.

2. A shoulder strap as claimed in claim 1 wherein a pivot means is attached to each end.

3. A shoulder strap as claimed in claim 1 wherein said attachment means includes a plurality of openings.

* * * * *